US005624495A

United States Patent [19]

Trefz et al.

[11] Patent Number: 5,624,495

[45] Date of Patent: Apr. 29, 1997

[54] COATING SYSTEM INCLUDING FLEXIBLE BLADE FOR COATING WEB MATERIAL

[75] Inventors: Michael Trefz; Christoph Henninger, both of Heidenheim, Germany

[73] Assignee: Voith Sulzer Papiermaschinen GmbH, Heidenheim, Germany

[21] Appl. No.: 377,024

[22] Filed: Jan. 20, 1995

[30] Foreign Application Priority Data

Jan. 24, 1994 [DE] Germany ..... 44 01 737.5

[51] Int. Cl.[6] ..... B05C 17/00

[52] U.S. Cl. ..... 118/122; 118/123; 118/126; 118/413; 162/281; 15/256.5

[58] Field of Search ..... 118/70, 122, 123, 118/126, 203, 261, 413; 427/356; 162/281; 15/256.5; 101/157, 169, 365

[56] References Cited

U.S. PATENT DOCUMENTS 4,169,425 10/1979 Wohrle ..... 118/126

5,085,168 2/1992 Sollinger ..... 118/126

5,286,526 2/1994 Rantanen et al. ..... 118/413

FOREIGN PATENT DOCUMENTS 9117838 11/1991 WIPO .

*Primary Examiner*—Laura Edwards

*Attorney, Agent, or Firm*—Baker & Daniels

[57] ABSTRACT

A spreading system or coating system, preferably for webs of paper or cardboard, with a doctor element fashioned as a doctor blade. A substrate element B to be coated serves as backing for the doctor blade secured in a mounting. A first load system is located near the (exposed) dosing edge of the doctor blade. A further load system acts on the doctor blade between the mounting and first load system. A pressure bar is fastened to the doctor blade in the area of its exposed dosing edge, preferably between 0 and 40 mm away from it, or bears on it, and the first load system acts on the pressure bar.

3 Claims, 3 Drawing Sheets

COATING SYSTEM INCLUDING FLEXIBLE BLADE FOR COATING WEB MATERIAL

BACKGROUND OF THE INVENTION

The present invention concerns a spreading system or coating system, preferably for use with webs of paper or cardboard. In a coating system of this type, a doctor element is fashioned as a doctor blade. A substrate element to be coated serves as backing for the doctor blade, and is secured in a mounting. A first load system is located near the exposed dosing edge of the doctor blade, and a further load system acts on the doctor blade between the mounting and the first load system. Such a coating system is known from WO 91/17838. This coating system is specifically designed to alter the geometry of the doctor blade in such a way that its contact pressure at the surface being coated will thereby be influenced little or, conversely, that the alteration of the contact pressure has little effect on the blade geometry. This allows the creation of clearer coating conditions.

The problem underlying the invention is to render the dosing edge of the blade more controllable.

SUMMARY OF THE INVENTION

This problem is solved by the features of the present invention. A pressure bar is provided which is fastened to the doctor blade in the area of its exposed dosing edge, preferably between 0 and 40 mm away from it, or bears on it. The first load system acts on the pressure bar.

DETAILED DESCRIPTION OF THE INVENTION

Figure 1:
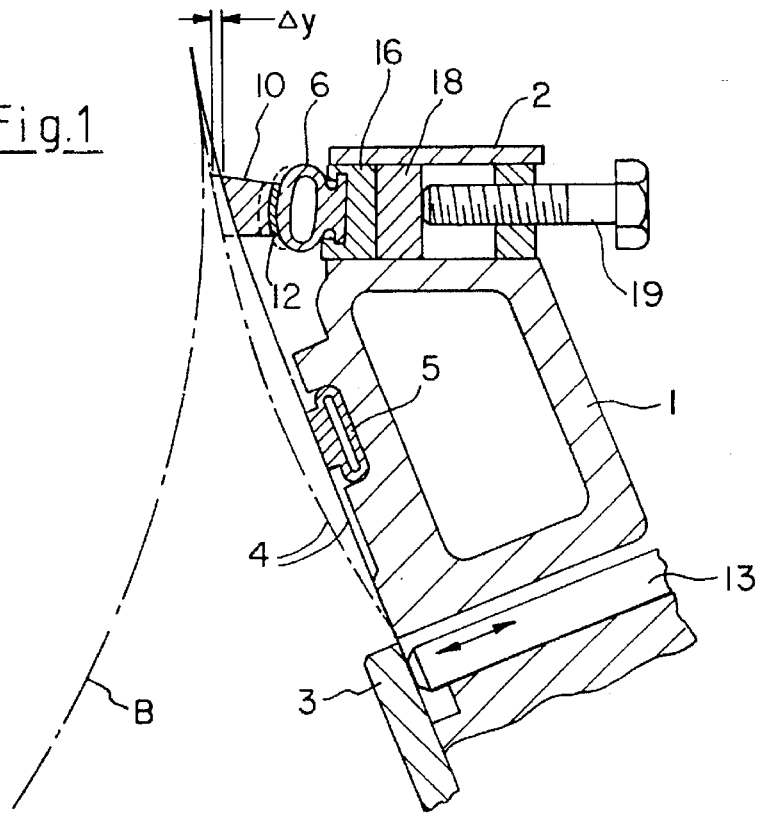
FIG. 1 shows a coating system according to the present invention, in cross section.

The surface to be coated, which may be a web or a backing roll, is referenced B in FIG. 1. The doctor blade 4 is fixed on a beam 1 and a mounting 3 by means of thrust plate 13. A first contact device is retained in a guide 2 of beam 1 and consists essentially of a compression hose 6 and adjustment screws 19 acting via a thrust plate 18 on the pressure hose 6, which is fixed in a holder 16.

The doctor blade 4 is illustrated in two positions, the solid line representing essentially the unflexed shape in the center area, while the shape according to the dash-dot line is created by the second load device fashioned as pressure hose 5. A pressure bar 10 is provided near the dosing edge of the doctor blade, in an area spaced between 0 and 40 mm from the dosing edge, and is pressed down on the doctor blade by the pressure hose 6.

In this case, the pressure bar 10 is permanently joined to the doctor blade, for instance by gluing. When the pressure bar 10 is made of metal, a metal adhesive may be used, particularly since the doctor blade also consists, generally, of spring steel (or also bronze). The pressure bar 10 slides relatively freely on the pressure hose 6 in the plane of the doctor blade, for which purpose a slider bar 12 with relatively little frictional resistance is fastened to the pressure hose 6, for instance by vulcanizing. The slider bar 12 may consist of polyvinyl chloride, a polyamidimine or a polyaminimide.

Figure 3:
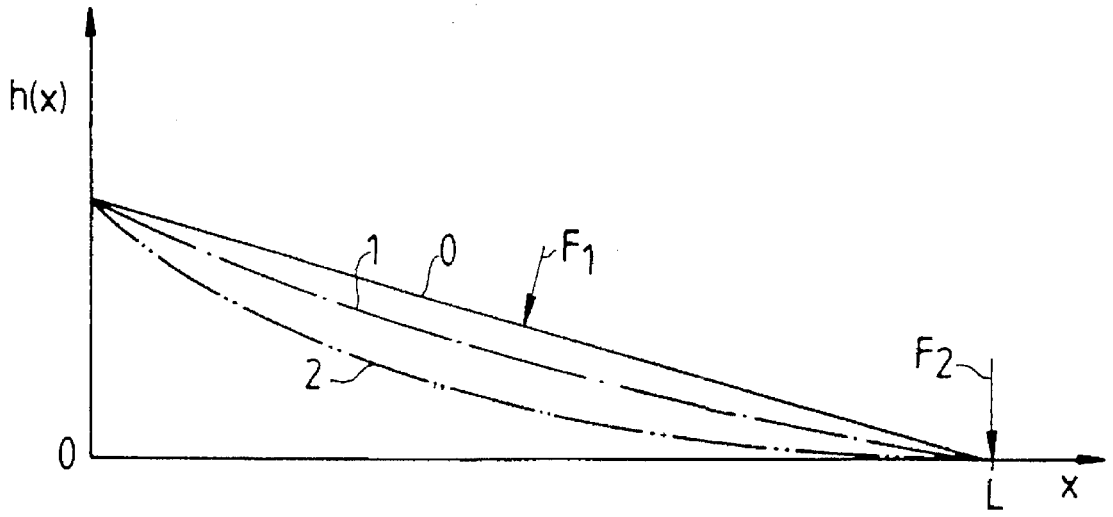
FIG. 3 shows a first diagram indicating the various gap geometries, or functions h(x).
Figure 3A:
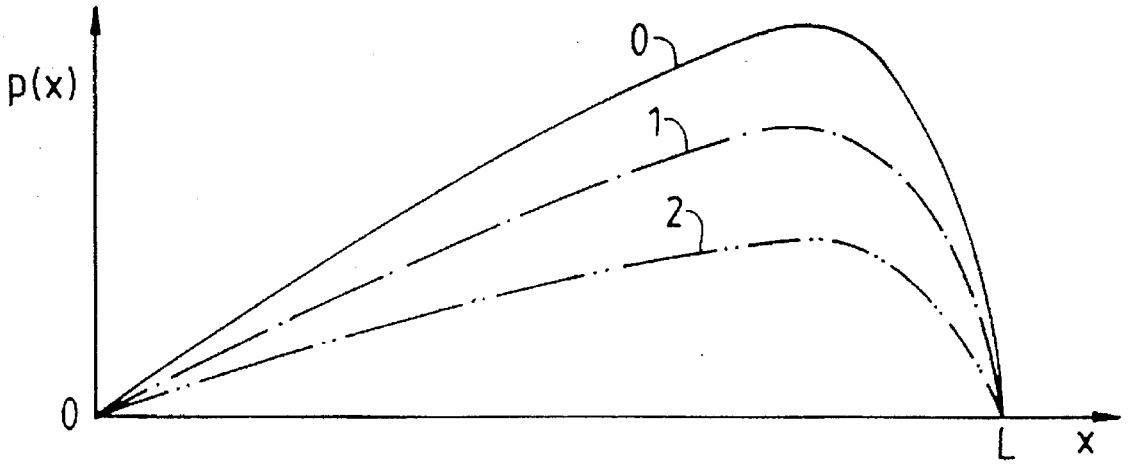
FIG. 3*a* shows a second diagram indicating various pressure patterns p(x) in the gap.

The following comments relate to the groups of curves shown in FIGS. 3 and 3*a*. The flexible blade 4 (notably as a so-called bent blade) and the backing roll B form a converging gap (FIG. 1). The blade can be bent to different degrees by means of the rubber hose 6, which can be inflated with compressed air. This allows adjusting various gap geometries.

The contingence of gap height h on the path coordinate x may be represented by a function h(x), (FIG. 3). With the described configuration, an entire group of curves h(x) can be adjusted variably during operation, depending on the pressure in the hose.

FIG. 3 shows schematically the various gap geometries, or functions, h(x). FIG. 3*a* illustrates the resulting pressure pattern p(x) in the gap.

The pressure buildup in tile gap is decisive for the amount of film Q dosed in the narrowest cross section (x=L). The pressure in the gap depends substantially on rheological properties of the dye, namely its viscosity, and the velocity of the backing roll, or web of material. (The zero point on the X-axis is approximately the blade mounting or a point near it.)

Differently adjustable pressure patterns in the gap allow a specific and finely dosed response to these variables. The control characteristic of the blade suited for a required dosing amount $Q_{set}$ can thus be adapted to color and speed without retrofitting.

The force $F_1$ is generated by the pressure hose 5, the force $F_2$ by the pressure hose 6.

To guarantee a sufficient flexibility of the blade, it must be relatively thin. But this entails the disadvantage that dosed amounts that differ zonewise (for instance across a width of 9 m) cannot be, or only with great difficulty, balanced out. Besides, the highest hydrodynamic pressure prevails in the frontmost area of the blade (FIG. 3*a*). Therefore, the blade 4 described is preferably reinforced on its free end (narrowest gap width) with a bar 10 that is arranged across the entire width and has a sufficient bending resistance.

This bar lends the blade the desired stability at its point. At the same time, however, the blade still is sufficiently flexible to allow flexure by slight distances Ay by the profile screws 19 indicated in FIG. 1, for instance at spacings of 100 mm each.

Moreover, a result of this bar (FIG. 1) is that the angle between roll B and the point of the blade remains maximally unchanged, regardless of the flexure.

In this manner it is possible to effect profile corrections, without disturbing the pressure buildup in the gap and, thus, the amounts of application. The control of application quantities through the gap h(x) is thus extensively decoupled from the exertion of influence on the cross profile.

The line B can be substituted also for the paper or cardboard web that is to be coated, or on which the ultimate layer application is to be dosed.

Figure 2:
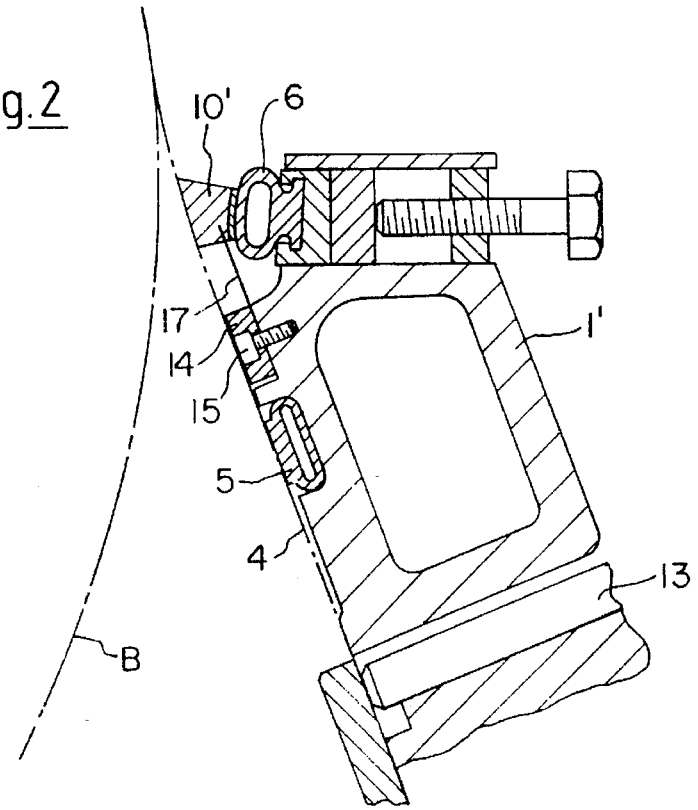
FIG. 2 shows another embodiment of a coating system according to the present invention, also in cross section.
Figure 1A:
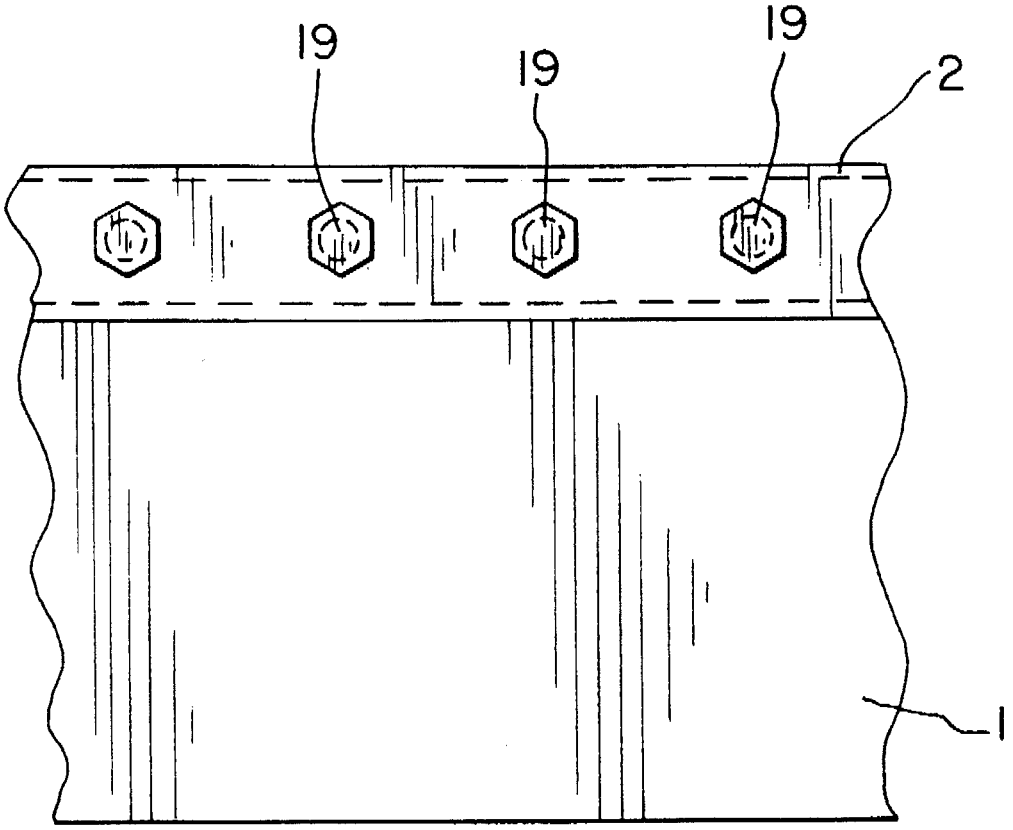
FIG. 1*a* shows a sectional view of the coating system of FIG. 1 taken across the width of the coating system.

In FIG. 2, which essentially shows a similar arrangement, the pressure bar 10' is being held on the beam 1' through a leaf spring 17, pressure bar 14 and screws 15. The leaf spring 17 is relatively thin and bends easily, allowing the pressure bar 10' to move very easily to the required position in keeping with the blade geometry.

What is claimed is:

1. A coating system for a web material, comprising:

a doctor element fashioned as a doctor blade, said doctor blade having a dosing edge;

a substrate element comprising a backing for the doctor blade;

a mounting member for securing the doctor blade;

a first load system located in closely spaced relationship to the dosing edge of the doctor blade, said first load system including a contact element, said contact element comprising a pressure hose;

a second load system positioned between the mounting member and the first load system; and a pressure bar positioned in the area of the dosing edge of the doctor blade, said pressure bar being either fastened to the doctor blade or bearing on the doctor blade, said pressure bar being oriented with respect to said first load system such that said first load system acts on the pressure bar via a slide element situated between the pressure hose and the pressure bar, said slide element being secured to the pressure hose.

2. The system of claim 1, further comprising adjustment screws for acting on the pressure hose.

3. The system of claim 1, wherein said slide element comprises a slide rail or a slide bar.

* * * * *